US005580165A

United States Patent [19]

Natsume et al.

[11] Patent Number: 5,580,165

[45] Date of Patent: Dec. 3, 1996

[54] VEHICULAR LAMP HAVING APPEARANCE OF DEPTH

[75] Inventors: Kazunori Natsume; Nobuhiro Taki, both of Shizuoka, Japan

[73] Assignee: Koito Manufacturing Co., Ltd., Tokyo, Japan

[21] Appl. No.: 361,552

[22] Filed: Dec. 22, 1994

[30] Foreign Application Priority Data

Dec. 22, 1993 [JP] Japan ..... 5-073211 U

[51] Int. Cl.[6] ..... F21V 5/00

[52] U.S. Cl. ..... 362/331; 362/61; 362/309; 362/332

[58] Field of Search ..... 362/308, 309, 362/326–333, 61, 80

[56] References Cited

U.S. PATENT DOCUMENTS

| | | | |
|---|---|---|---|
| 2,848,601 | 8/1958 | Beach | 362/331 |
| 2,887,568 | 5/1959 | Franck | 362/309 |
| 3,721,818 | 3/1973 | Stahlhut | 362/330 |
| 4,153,928 | 5/1979 | Speedy | 362/331 |
| 4,383,290 | 5/1983 | Binder et al. | 362/329 |
| 5,161,885 | 11/1992 | Segaud et al. | 362/332 |
| 5,274,536 | 12/1993 | Sato | 362/331 |

FOREIGN PATENT DOCUMENTS

| | | | |
|---|---|---|---|
| 1497912 | 9/1967 | France | 362/309 |
| 2675751 | 10/1992 | France | 362/309 |

*Primary Examiner*—Denise L. Gromada
*Assistant Examiner*—Alan B. Cariaso
*Attorney, Agent, or Firm*—Sughrue, Mion, Zinn, Macpeak & Seas

[57] ABSTRACT

An outer lens includes transparent segmental areas and first fisheye step groups, and an inner lens also includes transparent segmental areas and second fisheye step groups. The first and second fisheye step groups are shifted in the depth direction of the lamp so as to slightly overlap when viewed from the front side of the identification lamp.

22 Claims, 4 Drawing Sheets

VEHICULAR LAMP HAVING APPEARANCE OF DEPTH

BACKGROUND OF THE INVENTION

The present invention relates to a vehicular lamp, more particularly, the invention provides a vehicular lamp having a novel outer lens which makes the lamp have an appearance of depth.

In the outer lens of a conventional vehicular lamp fisheye steps are often formed over the entire surface of the lens so as to conceal the interior of the lamp, or cylindrical steps are formed over the entire surface of the lens, so that the interior of the lamp can be seen from the outside. The conventional lamp thus looks flat as a whole due to the presence of the fisheye steps or cylindrical steps.

SUMMARY OF THE INVENTION

The present invention was made in view of the disadvantages accompanying the conventional lamp, and an object of the invention is to provide a vehicular lamp having a lamp body and a lens for covering the lamp body, the lens includes at least two types of fisheye step groups, the two types of fisheye groups being shifted in the depth direction with respect to one another.

In the lamp thus constructed, since the two types of the fisheye step groups are shifted in the depth direction, the focal points of the first type of fisheye step group are offset, in the depth direction, from those of the second type of fisheye step group. Thus, the lamp has an appearance of depth when viewed from its front side.

BRIEF DESCRIPTION OF THE DRAWINGS

FIGS. 7A and 7B are enlarged front views showing the operation of the marker lamp of the second embodiment, in which FIG. 7A shows an area of the inner lens that is imaged on one fisheye in the first fisheye step group, and FIG. 7B shows an area of the inner lens that is imaged on one fisheye in the second fisheye step group.

DESCRIPTION OF THE PREFERRED EMBODIMENTS

Preferred embodiments of a vehicular lamp according to the present invention will be described in detail with reference to the accompanying drawings.

Figure 1:
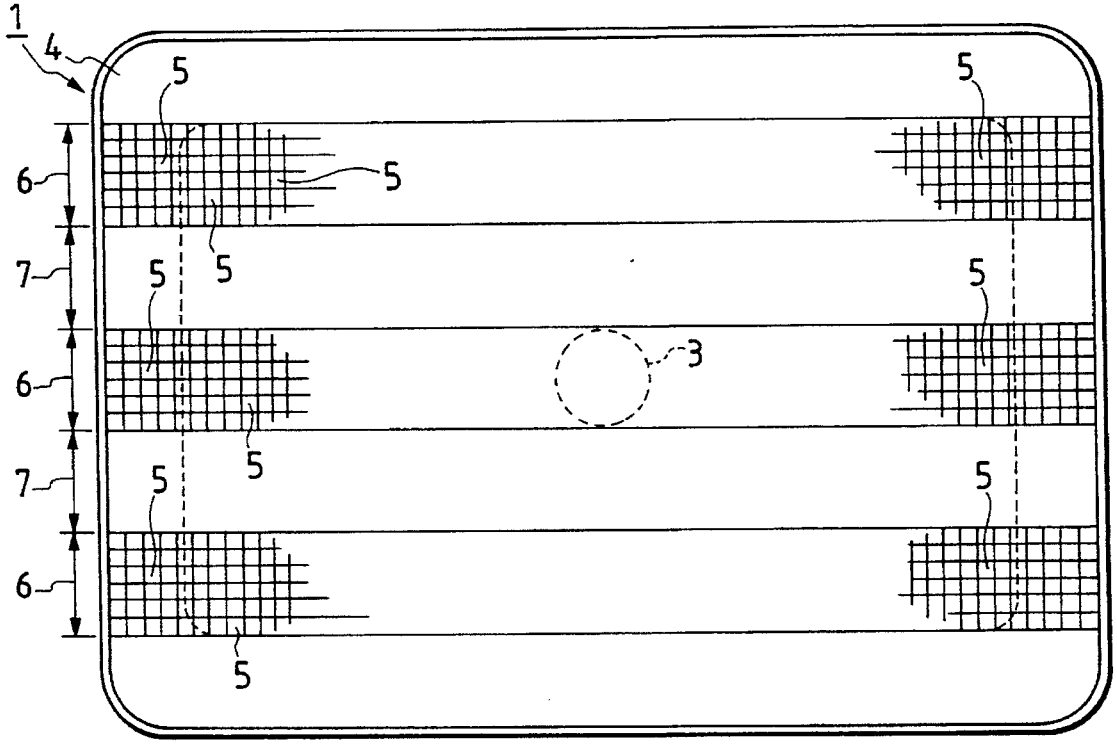
FIG. 1 is a front view showing, in cooperation with FIGS. 2 and 3, a first embodiment of a vehicular lamp constructed according to the present invention.
Figure 2:
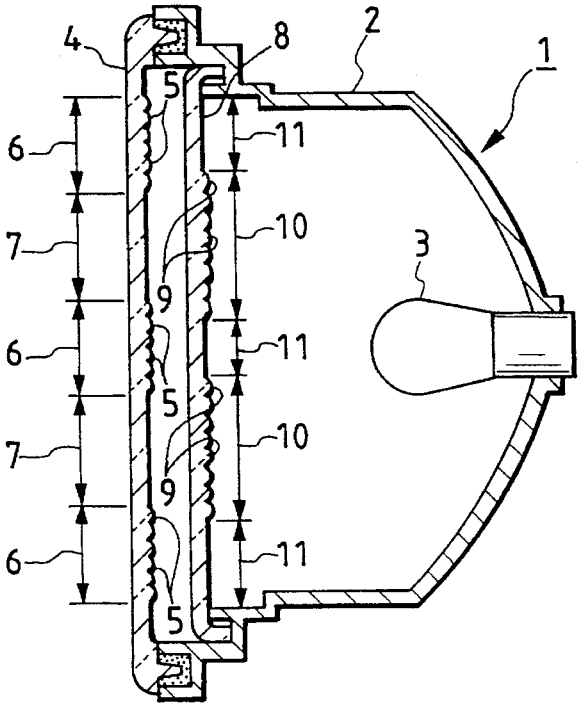
FIG. 2 is a longitudinal sectional view of the lamp shown in FIG. 1.
Figure 3:
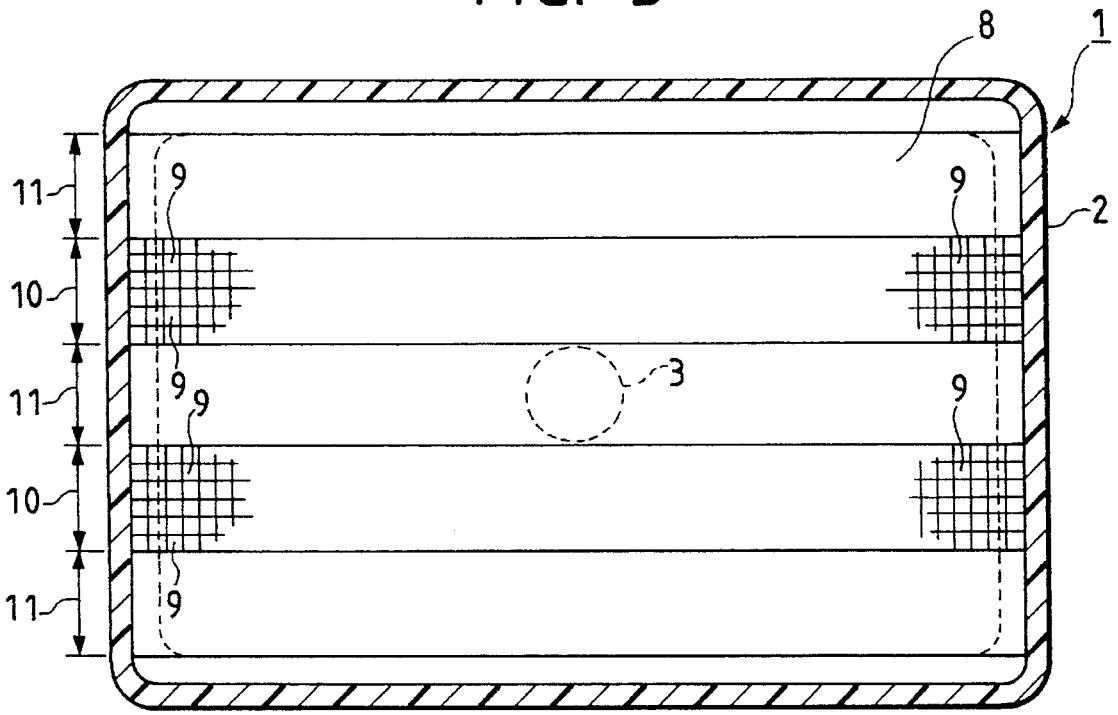
FIG. 3 is a front view showing an inner lens employed in the lamp shown in FIG. 1.
Figure 4:
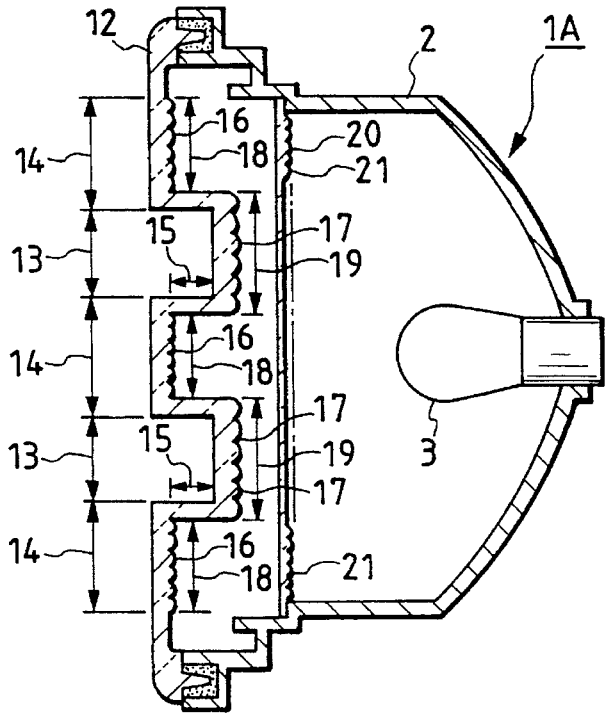
FIG. 4 is a longitudinal sectional view showing, in cooperation with FIGS. 5 to 7B, a second embodiment of a vehicular lamp according to the present invention.
Figure 5:
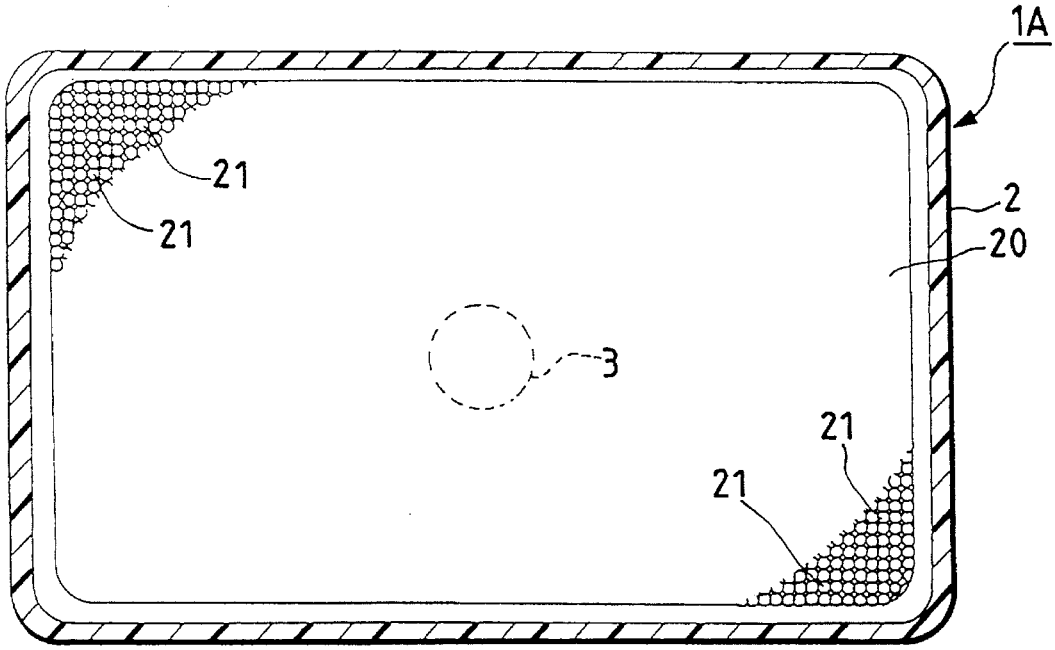
FIG. 5 is a front view showing an inner lens used in the lamp of the second embodiment.

FIG. 1 through 3 show a first embodiment of a vehicular lamp according to the present invention. In the first embodiment, the present invention is applied to a marker lamp 1 for a motor vehicle.

The marker lamp 1 is provided with a lamp body 2 having a front opening and a bulb 3 disposed at the central part of the rear portion of the lamp body 2. An outer lens 4 made of a transparent synthetic resin is attached to the lamp body 2 so that the front opening of the lamp body 2 is covered with the outer lens 4.

The outer lens 4 is segmented in the vertical direction thereof into five segmental areas that are equal in width. Fisheye steps 5 are formed on the rear surface of the top, the middle, and the bottom of the segmental areas. Groups 6 of those fisheye steps 5 will be referred to as a first fisheye group. The remaining segmental areas 7 are transparent since these areas include no lens steps formed thereon.

An inner lens 8, which is also made of transparent synthetic resin, is disposed on the inner side of the outer lens 4. The inner lens 8 is also segmented in the vertical direction into five segmental areas that are equal in width. Fisheye steps 9 are formed on the rear surface of the second segmental areas as counted from the top and the bottom. The group 10 of those fisheye steps 9 will be referred to as a second fisheye group. The remaining segmental areas 11 are transparent since these areas include no lens steps formed thereon. The fisheye step groups 6 of the outer lens 4 are aligned with the transparent segmental areas 11 of the inner lens 8 when seen from the front side of the lamp.

In the marker lamp for a motor vehicle thus constructed, the first fisheye step group 6 and the second fisheye step group 10 are disposed in such a state that the first and second fisheye groups are shifted in the depth direction. Therefore, the focal points of fisheye steps 5 are offset, in the depth direction, from those of the second type of fisheye steps 9. The marker lamp thus has an appearance of depth when viewed from its front side. Particularly, when viewing the marker lamp from just above or below the axial line of the lamp, the appearance of depth of the marker lamp is more pronounced.

The distance between the outer lens 4 and the inner lens 8 is preferably selected from a range of 3 mm to 10 mm. If less than 3 mm, the appearance of depth is insufficient. If longer than 10 mm, when obliquely viewing the marker lamp from a distance above and below the axial line of the lamp, the bulb 3 can seen from outside through the transparent segmental areas 7 and 11 of the outer lens 4 and the inner lens 8. In an arrangement where the fisheye step groups 6 and the 10 overlap each other as illustrated, one cannot see the bulb 3 through the transparent segmental portions 7 and 11 even when viewing the marker lamp from a distance above and below the axial line of the lamp.

FIGS. 4 through 7B show a second embodiment of a vehicular lamp according to the present invention. In this embodiment as well, the present invention is applied to a marker lamp 1A for a motor vehicle.

The marker lamp 1A is provided with an outer lens 12 made of a transparent synthetic resin and which is mounted to cover the front opening of the lamp body 2. The outer lens 12 is vertically segmented into five segmental areas. The second segmental areas 13 as counted from the top and the bottom are located closer to the bulb 3 of the lamp than the remaining segmental areas 14 when seen in cross section. Coupling portions 15 couple the forward segmental areas 14 with the rear segmental areas 13.

Fisheye steps 16 are formed on the rear surface of the fore segmental areas 14, while fisheye steps 17 are formed on the rear surface of the rear segmental areas 13. The group 18 of the fisheye steps 16 will be referred to as a first fisheye step group, and the group 19 of the fisheye steps 17 will be referred to as a second fisheye step group.

The marker lamp 1A is also provided with a transparent synthetic resin inner lens 20 located behind the outer lens 12 as viewed in the drawing. Steps 21, which are circular when viewed from the front and semicircular in cross section, viz., shaped like dewdrops, are formed on the rear surface of the inner lens 20.

Figure 6:
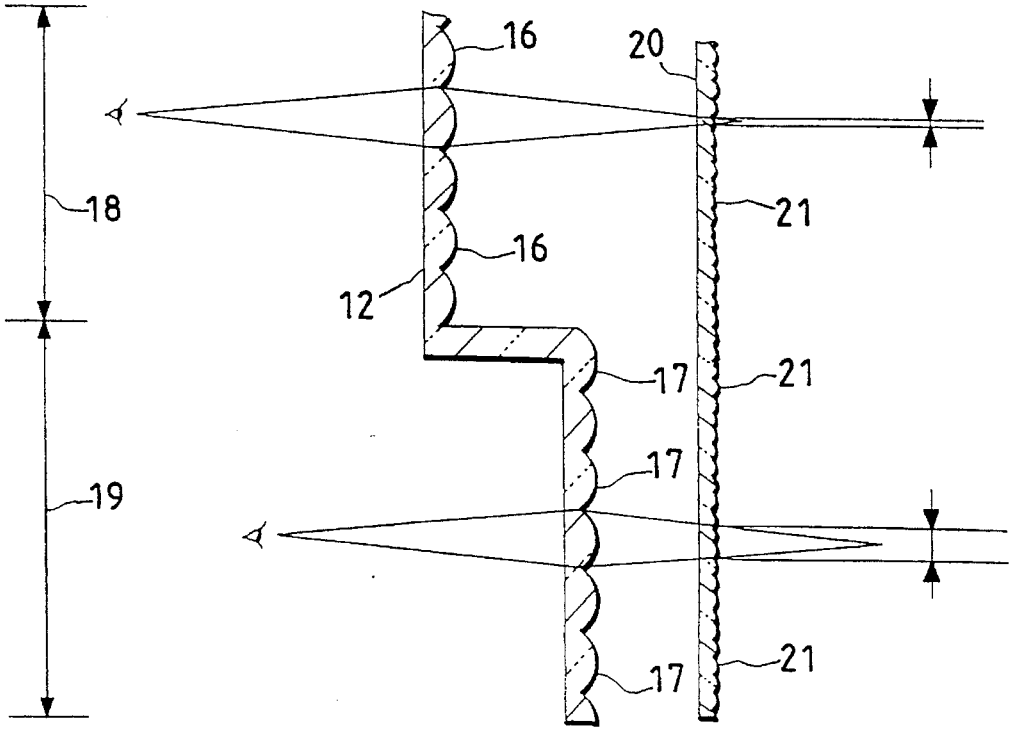
FIG. 6 is an enlarged, sectional view showing the operation of the lamp of the second embodiment.
Figure 7A:
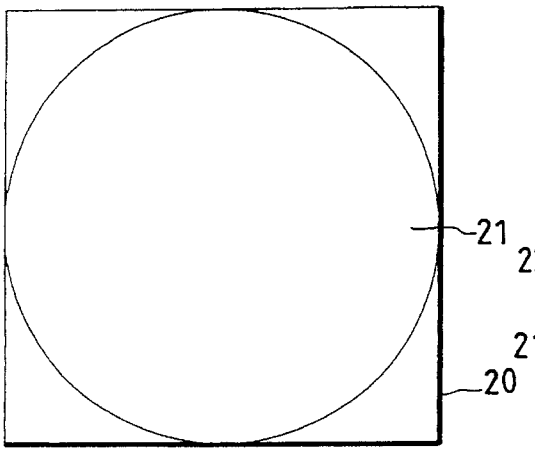
Figure 7B:
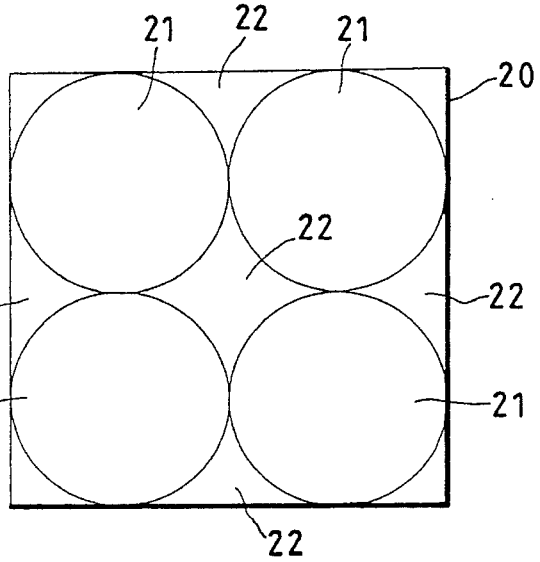

In the above-described marker lamp 1A, the focal length of each of the fisheye steps 16 is equal to that of the fisheye steps 17. The fisheye steps 16 are designed to focus the light beams on the dewdrop steps 21. Accordingly, the enlarged and glittering dewdrop steps 21 are imaged at the fisheye steps 16 of the first fisheye step group 18, as shown in FIGS. 6 and 7A. Wide areas of the inner lens 20, viz., a plural number of dewdrop steps 21, are imaged on the fisheye steps 17 of the second fisheye step group 19. More exactly, glittering portions are small and dark portions 22 are large as shown in FIG. 7B. As a whole, the dewdrop steps 21 in the second fisheye step group 19 are darker than those in the first fisheye step groups 18. The contrast of the large and bright areas 18 and the small and dark areas 19 creates an appearance of depth for the lamp.

Figure 8:
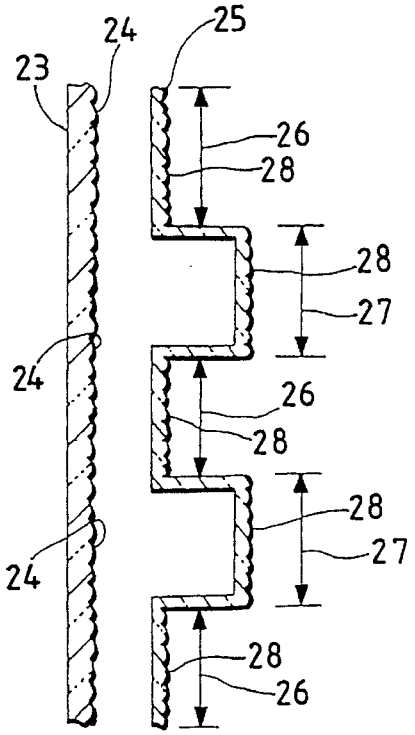
FIG. 8 is a longitudinal sectional view showing a modification of the second embodiment.

An alternative construction is illustrated in FIG. 8. In this arrangement, fisheye steps 24 are formed on the entire rear side of an outer lens 23. An inner lens 25 includes first segmental areas 26 and second segmental areas 27. The first segmental areas 26 are located closer to the outer lens 23 than the second segmental areas 27. Dewdrop steps 28 are formed on the rear surface of both the first and second segmental areas 26 and 27.

As seen from the foregoing description, the vehicular lamp of the present invention is characterized in that the front opening of the lamp body is covered with a lens, the lens includes at least two types of fisheye step groups, and two types of fisheye groups are shifted in the depth direction.

In the marker lamp thus constructed, since the two types of the fisheye step groups are shifted in the depth direction, the focal points of the first type of fisheye step group are offset, in the depth direction, from those of the second type of fisheye step group. The lamp thus has an appearance of depth when viewed from its front side.

While in the above-mentioned embodiments two types of fisheye step groups are alternatingly arranged in the vertical direction, the fisheye groups may be alternatingly arranged in the horizontal direction.

It should be understood that the form of the invention herein shown and described is to be taken as preferred examples of the invention and that various changes in the shape, size and arrangement of parts may be resorted to without departing from the spirit of the invention or the scope of the subjoined claims.

What is claimed is:

1. A vehicular lamp comprising:

a cup-shaped lamp body having a front opening;

a light source mounted at a center portion of said lamp body; and lens means covering said front opening of said lamp body, said lens means comprising:

a first lens step group spaced apart from said light source by a first distance; and a second lens step group spaced apart from said light source by a second distance, said second distance being shorter than said first distance, wherein said first lens step group is provided in a plurality of first segmental areas and said second lens step group is provided in a plurality of second segmental areas, with said first and second segmental areas being staggered with respect to each other.

2. The vehicular lamp according to claim 1, wherein said lens means comprises an outer lens and an inner lens, said first lens step group being formed on said outer lens and said second lens step group being formed on said inner lens.

3. A vehicular lamp comprising:

a cup-shaped lamp body having a front opening;

a light source mounted at a center portion of said lamp body; and lens means covering said front opening of said lamp body, said lens means comprising:

a first lens step group spaced apart from said light source by a first distance; and a second lens step group spaced apart from said light source by a second distance, said second distance being shorter than said first distance, wherein said lens means comprises an outer lens and an inner lens, said first lens step group being formed on said outer lens and said second lens step group being formed on said inner lens, and wherein both said outer lens and said inner lens are segmented into a plurality of segmental areas, the number of segmental areas of said outer lens being the same as that of said inner lens, said first lens step group being formed in an odd number of said segmental areas of said outer lens, and said second lens step group being formed in an even number of said segmental areas of said inner lens.

4. The vehicular lamp according to claim 3, wherein both said outer and inner lens are segmented in the vertical direction of said lens means.

5. The vehicular lamp according to claim 3, wherein both said outer and inner lens are segmented into five segmental areas.

6. The vehicular lamp according to claim 1, wherein a difference between said first distance and said second distance is within a range of 3 mm to 10 mm.

7. The vehicular lamp according to claim 2, wherein a difference between said first distance and said second distance is within a range of 3 mm to 10 mm.

8. A vehicular lamp comprising:

a cup-shaped lamp body having a front opening;

a light source mounted at a center portion of said lamp body; and lens means covering said front opening of said lamp body, said lens means comprising:

a first lens step group spaced apart from said light source by a first distance; and a second lens step group spaced apart from said light source by a second distance, said second distance being shorter than said first distance, wherein said lens means comprises an outer lens and an inner lens, said first lens step group being formed on said outer lens and said second lens step group being formed on said inner lens, and wherein both said first and second lens step groups comprise fisheye steps.

9. The vehicular lamp according to claim 1, wherein said lens means comprises an outer lens having a first plane and a second plane spaced from said first plane in a depth direction of said lamp body, said first lens step group being formed in said first plane, and said second lens step group being formed in said second plane.

10. A vehicular lamp comprising:

a cup-shaped lamp body having a front opening;

a light source mounted at a center portion of said lamp body; and lens means covering said front opening of said lamp body, said lens means comprising:

a first lens step group spaced apart from said light source by a first distance; and a second lens step group spaced apart from said light source by a second distance, said second distance being shorter than said first distance, wherein said lens means comprises an outer lens having a first plane and a second plane spaced from said first plane in a depth direction of said lamp body, said first lens step group being formed in said first plane, and said second lens step group being formed in said second plane, and further comprising an inner lens and a third lens step group formed on said inner lens.

11. The vehicular lamp according to claim 10, wherein said third lens step group comprises steps which are circular when viewed from the front and semicircular in cross section, thus being shaped like dewdrops.

12. The vehicular lamp according to claim 9, wherein said outer lens is segmented into a plurality of segmental areas.

13. The vehicular lamp according to claim 12, wherein said first plane includes an odd number of said segmental areas and said second plane includes an even number of said segmental areas.

14. The vehicular lamp according to claim 12, wherein said outer lens is segmented in the vertical direction thereof.

15. The vehicular lamp according to claim 12, wherein said outer lens is segmented into five segmental areas.

16. A vehicular lamp comprising:

a cup-shaped lamp body having a front opening;

a light source mounted at a center portion of said lamp body; and lens means covering said front opening of said lamp body, said lens means comprising:

a first lens step group spaced apart from said light source by a first distance; and a second lens step group spaced apart from said light source by a second distance, said second distance being shorter than said first distance, wherein said lens means comprises an outer lens having a first plane and a second plane spaced from said first plane in a depth direction of said lamp body, said first lens step group being formed in said first plane, and said second lens step group being formed in said second plane, and wherein both said first and second lens step group comprise fisheye steps.

17. The vehicular lamp according to claim 10, wherein both said first and second lens step groups comprise fisheye steps.

18. The vehicular lamp according to claim 17, wherein each of said fisheye steps of said first plane focus light onto said inner lens.

19. The vehicular lamp according to claim 1, wherein said lens means comprises an inner lens having a first plane and a second plane spaced from said first plane in a depth direction of said lamp body, said first lens step group being formed on said first plane, and said second lens step group being formed on said second plane.

20. The vehicular lamp according to claim 19, wherein said inner lens is vertically segmented into five segmental areas.

21. The vehicular lamp according to claim 19, further comprising an outer lens and a third lens step group formed on said outer lens.

22. A vehicular lamp comprising:

a cup-shaped lamp body having a front opening;

a light source mounted at a center portion of said lamp body; and lens means covering said front opening of said lamp body, said lens means comprising:

a first lens step group spaced apart from said light source by a first distance; and a second lens step group spaced apart from said light source by a second distance, said second distance being shorter than said first distance, wherein said lens means comprises an inner lens having a first plane and a second plane spaced from said first plane in a depth direction of said lamp body, said first lens step group being formed on said first plane, and said second lens step group being formed on said second plane, further comprising an outer lens and a third lens step group formed on said outer lens, and, wherein said first and second lens step groups formed on said inner lens comprise fisheye steps, and said third lens step group formed on said outer lens comprises steps which are circular when viewed from the front and semicircular in cross section, thus being shaped like dewdrops.

* * * * *